US006713537B1

(12) United States Patent
Ueda et al.

(10) Patent No.: US 6,713,537 B1
(45) Date of Patent: Mar. 30, 2004

(54) REGENERATED COLLAGEN FIBER WITH EXCELLENT HEAT RESISTANCE

(75) Inventors: Masahiro Ueda, Hyogo (JP); Yoshihiro Makihara, Hyogo (JP); Takashi Ueda, Hyogo (JP); Kunihiko Matsumura, Hyogo (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 10/031,290

(22) PCT Filed: Jul. 13, 2000

(86) PCT No.: PCT/JP00/04711

§ 371 (c)(1),
(2), (4) Date: Jun. 3, 2002

(87) PCT Pub. No.: WO01/06045

PCT Pub. Date: Jan. 25, 2001

(30) Foreign Application Priority Data

Jul. 14, 1999 (JP) ..... 11-200294

(51) Int. Cl.[7] ..... C08J 5/10; C08L 89/00
(52) U.S. Cl. ..... 524/17; 524/21; 524/23
(58) Field of Search ..... 524/17, 21, 23, 524/27

(56) References Cited

U.S. PATENT DOCUMENTS 4,314,800 A * 2/1982 Monsheimer et al. ..... 8/94.1 R

FOREIGN PATENT DOCUMENTS

| | | |
|---|---|---|
| JP | 5-106106 | 4/1993 |
| JP | 7-97718 | 4/1995 |

* cited by examiner

*Primary Examiner*—James J. Seidleck
*Assistant Examiner*—U. K. Rajguru
(74) *Attorney, Agent, or Firm*—Brinks Hofer Gilson & Lione

(57) ABSTRACT

A regenerated collagen fiber which comprises 100 parts by weight of collagen and 1 to 100 parts by weight of a thermoplastic resin and has such excellent heat resistance that it is less apt to be thermally damaged even in styling with a hair iron or dryer. The thermoplastic resin is one obtained by polymerizing at least one member selected from the group consisting of alkyl acrylate monomers, alkyl methacrylate monomers, acrylic acid, methacrylic acid, vinyl cyanide monomers, aromatic vinyl monomers and halogenated vinyl monomers.

7 Claims, No Drawings

REGENERATED COLLAGEN FIBER WITH EXCELLENT HEAT RESISTANCE

RELATED APPLICATIONS

This application is a nationalization of PCT application PCT/JP00/04711 filed Jul. 13, 2000. This application claims priority from the PCT application and Japan Application Serial No. Hei 11-200294 filed Jul. 14, 1999.

TECHNICAL FIELD

This invention relates to a regenerated fiber. More particularly, it relates to a regenerated collagen fiber with excellent heat resistance, which can suitably be used for human hair or fur, or as thread to be wound by hand.

BACKGROUND ART

Among the protein fibers, the regenerated collagen fiber exhibits a high mechanical strength like silk; and, thus, has been used in various fields. Particularly, the regenerated collagen fiber is a protein fiber maintaining a characteristic molecular structure derived from collagen and, thus, is close in drape, luster and feel to the human hair that is a natural protein fiber having complex fine structure. Such being the case, there have been attempts to use the regenerated collagen fiber as a replacement for human hair or in an animal hair-like fiber such as a fur (for example, see Japanese Patent Laid-Open No. 168628/1998 and Japanese Patent Laid-Open No. 168629/1998).

In general, the skin or bone of an animal is used as a raw material for the regenerated collagen fiber. The regenerated collagen fiber can be produced by treating these raw materials with an alkali or an enzyme to obtain a water-soluble collagen, followed by extruding and spinning the water-soluble collagen in an aqueous solution of an inorganic salt. Since the regenerated collagen fiber thus obtained is soluble in water, some treatments are applied thereto in order to impart resistance to water to the collagen fiber. As a method for making the regenerated collagen fiber insoluble in water, there are known methods including treating the water-soluble collagen fiber with an aldehyde compound such as formaldehyde or glutaric aldehyde; treating the water-soluble collagen fiber with metal salts such as various chromium salts, aluminum salts or zirconium salts; treating the water-soluble collagen fiber with an epoxy compound; and treating the regenerated collagen fiber with a combination of the above-described methods (for example, Japanese Patent Laid-Open No. 173161/1994).

However, being produced from collagen, the fiber produced by these methods has a lower heat resistance than that of human hair or animal hair containing keratin as a major component, and is susceptible to thermal damages (contraction in length, curling or hardening of hair tips) upon styling with a hair iron or dryer, thus rendering such styling unsatisfactory in view of its inherent properties (the term "styling" as used herein means to impart a desired form to human hair by thermal treatment in a beauty parlor or at home).

An object of the invention is to provide a regenerated collagen fiber with excellent heat resistance, which is less apt to be damaged even when styled with a hair iron or dryer.

SUMMARY OF THE INVENTION

Under such circumstances, as a result of intensive investigations, the inventors have found that the regenerated collagen fiber with excellent heat resistance can be obtained by compounding 1 to 100 parts by weight of a thermoplastic resin with 100 parts of collagen. Specifically, the invention is embodied in a regenerated collagen fiber comprising 100 parts by weight of collagen and 1 to 100 parts by weight of a thermoplastic resin, with the thermoplastic resin preferably being obtained by polymerizing at least one member selected from the group consisting of alkyl acrylate monomers, alkyl methacrylate monomers, acrylic acid, methacrylic acid, vinyl cyanide monomers, aromatic vinyl monomers, and halogenated vinyl monomers. The invention is also embodied in a method of producing such a regenerated collagen fiber.

BEST MODE FOR CARRYING OUT THE INVENTION

As a raw material of collagen to be used in the invention, split leather is preferred. The split leather can be obtained from a fresh raw hides or salted hides of animals such as cows. Such split leather primarily comprises insoluble collagen fibers, and is usually used after removing flesh portions attached thereto and a salt component used for preventing the leather from becoming putrid or deteriorated.

Split leather in this condition still contains impurities; for example, lipids such as glyceride, phospholipid and free fatty acids, and proteins other than collagen, such as sugar proteins and albumin. Since these impurities greatly affect (adversely) the spinning stability in forming fiber, the quality such as luster and elongation of the resultant fiber; and the odor, it is desirable to remove these impurities in advance. They may be removed, for example, by dipping split leather in lime to hydrolyze the fat components so as to loosen the collagen fiber, followed by applying a conventional hide treatment such as an acid-alkali treatment, an enzyme treatment and a solvent treatment.

The thus treated insoluble collagen is subjected to a solubilizing treatment in order to cut the crosslinking peptide portion. As such a solubilizing treatment, there may be employed an alkali solubilizing method or an enzyme solubilizing method, each of which is commonly employed as a solubilizing treatment method.

In the case of employing the alkali solubilizng method, it is desirable to neutralize the solubilized collagen with an acid such as hydrochloric acid. It is also possible to employ the method described in Japanese Patent Publication No. 15033/71 as an improved alkali solubilizing method.

The use of an enzyme solubilizing method is advantageous in that it is possible to obtain a regenerated collagen having a uniform molecular weight. Thus, an enzyme solubilizing method can be favorably employed in the invention. As such an enzyme solubilizing method, the methods described in Japanese Patent Publication No. 25829/68 or Japanese Patent Publication No. 27513/68, for example, can be employed. Incidentally, it is possible in the invention to employ in combination both the alkali solubilizing method and the enzyme solubilizing method.

Where additional treatments such as pH adjustment, salting-out, water wash and treatment with a solvent are applied to the collagen after a solubilizing treatment has been applied, it is possible to obtain a regenerated collagen fiber having an excellent quality. Thus, it is desirable to apply these additional treatments to the solubilized collagen.

The solubilized collagen leather pieces thus obtained are dissolved in an acidic aqueous solution having the pH value adjusted to 2 to 4.5 with hydrochloric acid, acetic acid, lactic acid or the like to provide a stock solution of a predetermined concentration. For example, an aqueous solution of about 1 to about 15% by weight, preferably about 2 to about 10% by weight, of collagen is prepared.

According to the invention, a thermoplastic resin is added to either solubilized collagen leather pieces before the acid is added thereto, or to an aqueous solution of collagen to which the acid has been added. In either case, the resin is added in an amount of 1 to 100 parts by weight per 100 parts by weight of collagen.

The amount of the thermoplastic resin to be compounded is preferably 3 to 80 parts by weight, and more preferably 5 to 50 parts by weight. If the amount is less than 1 part by weight, the effect of improving heat resistance tends to become insufficient whereas, in case where there is more than 100 parts by weight, the result tends to be a fragile fiber which is difficult to handle, though heat resistance is improved.

The mechanism by which heat resistance improved by compounding the thermoplastic resin is not clear, but it may be presumed that thermoplastic resin particles existing inside the regenerated collagen fiber form some structure within the fiber which functions to inhibit deformation such as contraction of collagen molecules upon heating with a hair iron or the like.

As the thermoplastic resin to be compounded, there may preferably be used those resins which are prepared by homopolymerizing or copolymerizing two or more of the monomers such as alkyl acrylate monomers (alkyl moiety containing preferably 1 to 12, more preferably 1 to 6, carbon atoms) (e.g., methyl acrylate, ethyl acrylate, butyl acrylate or octyl acrylate); alkyl methacrylate monomers (alkyl moiety containing preferably 1 to 6, more preferably 1 to 4, carbon atoms) (e.g., methyl methacrylate or ethyl methacrylate); acrylic acid or methacrylic acid; vinyl cyanide monomers (e.g., acrylonitrile or methacrylonitrile); aromatic vinyl monomers (e.g., styrene or a-methylstyrene); and vinyl halide monomers (e.g., vinyl chloride or vinyl bromide). In addition to the monomers, crosslinking agents such as divinylbenzene, monoethylene glycol dimethacrylate and polyethylene glycol dimethacrylate may be used alone or as a mixture of two or more. Of these alkyl acrylate monomers, alkyl methacrylate monomers and aromatic vinyl monomers are preferred as the monomers for producing the resin to be compounded, with a combination of an alkyl acrylate monomer and an alkyl methacrylate monomer, and a combination of an alkyl acrylate monomer and an aromatic vinyl monomer being more preferred. In particular, a combination of methyl methacrylate and butyl acrylate and a combination of styrene and butyl acrylate are preferred.

The thermoplastic resin has a glass transition temperature of 0° C. to 120° C., preferably 30° C. to 100° C., and more preferably 30° C. to 80° C. The term "glass transition temperature" as used herein means a middle glass transition temperature of a peak measured at a temperature-raising rate of 10° C./min according to the method described in JISK7121. In the case where the glass transition temperature is less than 0° C., the thermoplastic resin particles are liable to agglomerate upon compounding, leading to formation of large masses which reduce the strength the of resultant regenerated collagen fiber containing them. On the other hand, in the case where the glass transition temperature exceeds 120° C., effects obtained by compounding the thermoplastic resin tend to be weakened.

Furthermore the thermoplastic resin particles have a particle size of preferably 5 $\mu$m or less, more preferably 1 $\mu$m or less, and still more preferably 0.5 $\mu$m or less. In the case where the particle size exceeds 5 $\mu$m, there tends to result a fragile fiber. For the thermoplastic resin particles, powder pulverized with a mill or latex particles prepared by emulsion polymerization or suspension polymeriation may be used. In particular, latex particles obtained by emulsion polymerization are uniform in particle size and has a good stability in water. Therefore, they are easy to handle; thus being preferably used.

In compounding the thermoplastic resin particles with the solubilized collagen, an acid is further added after compounding the thermoplastic resin particles, followed by stirring the mixture well in a kneader or the like for 2 hours or longer, preferably 5 hours or longer, to prepare an aqueous solution of collagen wherein the particles are uniformly dispersed. In addition, in compounding the thermoplastic resin with an aqueous solution of collagen, the mixture is stirred well for 1 hour or longer in a kneader or the like to uniformly disperse the thermoplastic resin particles in the aqueous solution of collagen. These procedures are conducted at a temperature of preferably 25° C. or lower. In case where the temperature is higher than 25° C., the aqueous solution of collagen might be denatured, leading to difficulty in stable production of fiber. Further, in the case of using a thermoplastic resin having a glass transition temperature of lower than 25° C., it is desirable to conduct the treatment at a temperature no higher than the glass transition temperature of the added resin in order to prevent agglomeration of the resin particles.

Additionally, the thus obtained aqueous solution of collagen may, if necessary, be subjected to a defoaming procedure by stirring under reduced pressure, or to a filtering procedure, to remove large-sized foreign matter.

Further, to the thus obtained aqueous solution of the solubilized collagen may, if necessary, be added additives such as a stabilizer and a water-soluble high-molecular compound in proper amounts. The purpose of this, for example, is improving mechanical strength, resistance to water and to heat, luster and spinning properties, preventing coloration and imparting antiseptic properties.

The aforesaid aqueous solution of the solubilized collagen is then discharged through, for example, a spinning nozzle or slit. The discharged solution is dipped in an aqueous solution of an inorganic salt so as to obtain a regenerated collagen fiber. As the aqueous solution of an inorganic salt, an aqueous solution of a water-soluble inorganic salt such as sodium sulfate, sodium chloride or ammonium sulfate. Usually, the inorganic salt concentration in the aqueous solution is adjusted to 10 to 40% by weight.

PH of the aqueous solution of the inorganic salt is desirably adjusted to 2 to 13, preferably 4 to 12, by adding a metal salt such as sodium borate or sodium acetate or hydrochloric acid, acetic acid or sodium hydroxide to the aqueous solution. In case where the pH value is smaller than 2 or exceeds 13, the peptide linkage of collagen is likely to be hydrolyzed, sometimes resulting in failure to obtain a desired fiber.

Also, it is desirable for the temperature of the aqueous solution of the inorganic salt, which is not particularly limited in the present invention, to be adjusted in general, for example, to 35° C. or lower. In case where the temperature of the aqueous solution is higher than 35° C., the soluble collagen is denatured or the mechanical strength of the spun fiber is lowered, with the result that it becomes difficult to manufacture fiber thread with a high stability. The lower limit of the temperature range is not particularly limited in the invention. It suffices to adjust the lower limit of the temperature appropriately in accordance with the solubility of the inorganic salt.

Then, these fibers are commonly treated with a crosslinking agent for improving resistance to water. As methods for treating with a crosslinking agent, there are illustrated, for example, a method of previously adding a crosslinking agent to the aqueous solution of an inorganic salt, and conducting the water resistance-imparting-treatment simultaneously with spinning, and a method of subjecting a spun regenerated collagen fiber to a treatment with a crosslinking agent.

As the crosslinking agent, there are illustrated, for example, monoaldehydes such as formaldehyde, acetaldehyde, methyl glyoxal, acrolein, and crotonaldehyde; dialdehydes such as glyoxal, malondialdehyde, succindialdehyde, glutaraldehyde, and dialdehyde starch; alkylene oxides such as ethylene oxide and propylene oxide; halogenated alkylene oxides such as epichlorohydrin; epoxy compounds including glycidyl ethers of aliphatic alcohol, glycol and polyols, and glycidyl esters of monocarboxylic acid, dicarboxylic acid, and polycarboxylic acid; N-methylol compounds derived from urea, melanin, acrylamide acrylic acid amide and polymers thereof; water soluble polyurethanes prepared by introducing isocyanate into a polyol or a polycarboxylic acid, followed by adding sodium hydrogen sulfite; triazine derivatives such as monochlorotriazine and dichlorotriazine; sulfate ester of oxyethyl sulfone or derivatives of vinyl sulfone; trichloropyridine derivatives; dichloroquinoxaline derivatives; N-methylol derivatives; isocyanate compounds; phenol derivatives; aromatic compounds having a hydroxyl group represented by tannin; and inorganic crosslinking agents of metal salts wherein a cation of metal such as aluminum, chromium, titanium or zirconium is combined with an anion such as sulfate ion, nitrate ion, halide ion represented by chloride ion or hydroxyl ion. However, the crosslinking agents to be used in the invention are not limited only to these. Other crosslinking agents may also be used which can reduce contraction with hot water, water absorption or swelling degree in water of the regenerated collagen and can make the regenerated collagen fiber insoluble in water. Additionally, water-insoluble crosslinking agents may be used as an emulsion or a suspension. These crosslinking agents may usually be used alone or as a mixture of two or more of them.

Of these crosslinking agents, metal salts can impart a particularly excellent heat resistance to the regenerated collagen. In particular, use of an aluminum salt realizes remarkable effects by the addition of the thermoplastic resin, thus being particularly preferred in the invention.

Further, in the invention, water wash, oiling and drying are applied as required to the regenerated collagen fiber.

Drying is usually conducted in a hot air convection dryer. The regenerated collagen fiber is liable to contract upon being dried, and it is extremely difficult for the once deformed collagen fiber to be formed into a desired form. Thus, in the invention, drying is conducted in a state wherein the fiber is fixed at both ends under tension or in a stretched state wherein a load is applied to both ends of the fiber so that the contraction ratio of the fiber after drying becomes 30% or less, preferably 20% or less, and still more preferably 10% or less without being broken. In case where the contraction ratio of the fiber thread after drying exceeds 30%, complicated unevenness tends to be formed on the surface of the fiber to cause detrimental influences on touch feel. The atmospheric temperature within the dryer is not particularly limited, but a temperature of not lower than the glass transition temperature of the added thermoplastic resin is preferred because the effect of improving heat resistance is more remarkable. This may be attributed to a continuous structure being formed within the regenerated collagen fiber by welding of the added thermoplastic resin particles to each other, which serves to improve heat resistance. Further, as to the atmospheric temperature within the dryer, it is preferably 100° C. or lower, and more preferably 90° C. or lower; because, in case where it is too high, the fiber might be colored or denatured. Drying lime is longer than that which is required to completely dry the fiber and shorter than that at which decoloration of the fiber becomes serious.

The water wash is intended to prevent precipitation of an oiling agent caused by a salt and to prevent the salt from being precipitated from the regenerated collagen fiber during drying within a drying machine. In the case where the salt is precipitated, the regenerated collagen fiber is cut or broken, and the formed salt scatters within the drying machine so as to be attached to the heat exchanger within the drying machine, leading to a low heat transfer coefficient. Also, the oiling is effective for preventing the fiber from hanging up in the drying step and for improving the surface state of the regenerated collagen fiber.

The thus obtained regenerated collagen fiber containing the thermoplastic resin has an excellent heat resistance, and enables styling with a hair iron or dryer to be conducted with the drape that a natural protein fiber has, being maintained. The fiber is, accordingly, more favorably usable as a substitute or a piece for improving human hair and animal hair.

The invention is now described in more detail by reference to Examples. However, the examples do not limit the invention in any way.

Additionally, in the invention, heat resistance of the regenerated collagen fiber is evaluated by measuring contraction ratio of the fiber and damage of the fiber at its tip upon applying thereto a hair iron, with these being taken as representative data for heat resistance. Fineness of the fiber is represented in terms of d (denier) and dtex (decitex).

Glass transition temperature and particle size of the thermoplastic resin used in Examples and heat resistance of the regenerated collagen fiber prepared in Examples upon applying a hair iron were measured according to the following methods.

(1) Glass Transition Temperature of the Thermoplastic Resin Particles

A thermoplastic resin latex obtained by emulsion polymerization was dried at 25° C. for 48 hours, then kept in a 25° C. vacuum dryer for 24 hours to obtain powder from which moisture was completely removed. About 10 mg of the powder was taken out according to the method described in JISK7121, and a middle-point glass transition temperature of the peak was read off, the peak being measured using differential scanning calorimeter (made by Seiko Denshi Kogyo K. K.; DSC-220C) under the conditions of −50° C. in initial temperature and 10° C./min in temperature-raising rate.

(2) Particle Size of the Thermoplastic Resin Particles

A thermoplastic resin latex obtained by emulsion polymerization was dried at 25° C. for 48 hours to obtain powder, and this powder was observed using a scanning type electron microscope (made by Hitachi, Ltd.; S-800) to measure the particle size.

(3) Heat Resistance Upon Applying a Hair Iron

The following procedures were conducted in an atmosphere of 20±2° C. in temperature and 65±2% in relative humidity.

After well opening the fibers, they were bunched in a length of 250 mm. To the bunch of fibers was lightly applied a hair iron (Perming Iron; made by Hakko Kogyo K. K.) heated to a varying temperature, and the hair iron was slid once rapidly (2 sec/slide) along the upper surface and the lower surface to evaporate moisture on the surface of the fibers. Then, the bunch of fibers was nipped with the iron, and the iron was slid from the base to the top of the bunch of fibers in 5 seconds. After this procedure, contraction ratio of the fiber bunch and the shrank state of the fiber at its tip were examined. Contraction ratio was determined from the following formula [1]

$$\text{Contraction ratio}=[(L-Lo)/L]\times 100 \quad [1]$$

wherein L represents a length of the fiber bunch before being treated with the iron, and Lo represents a length of the fiber bunch after being treated with the iron (in case where wave is formed in the fiber bunch upon treating with the iron, the length being measured by straightening the fiber bunch).

Hair iron heat resistance was described in terms of a hair iron heat-resistant temperature which was measured as the maximum temperature at which contraction ratio was 5% or less and no shrinkage was observed. The hair iron temperature was raised by 10° C., and the fiber bunch was changed to a new fiber bunch upon measuring at each different temperature.

EXAMPLE 1

Emulsion polymerization was conducted using 60 parts by weight of styrene, 40 parts by weight of butyl acrylate, and 1 part by weight of a surfactant of sodium laurylsulfate to obtain a latex containing 20% by weight of a solid component comprising resin particles having a glass transition temperature of 41° C. and a particle size of 0.1 μm. Further, 45 g of the latex (resin: 9 g) was mixed with 1200 g (collagen content: 180 g) of leather pieced obtained by solubilizing split leather with an alkali. Then, an aqueous solution of lactic acid and water were added thereto in a definite amount, and the mixture was stirred in a kneader (made by K. K. Irie Shokai; Model PNV-5; hereinafter the same) to prepare a stock solution having a pH adjusted to 3.5 and a solid component (comprising collagen and the thermoplastic resin) concentration adjusted to 7.5% by weight. Thereafter, the solution was subjected to a defoaming treatment by stirring under a reduced pressure (using a stirring defoamer, model 8DMV, made by Dalton Corporation) for one hour, followed by transferring the treated solution to a piston type spinning stock solution tank. The solution thus transferred was further allowed to stand under a reduced pressure to defoam. Then, the stock solution was extruded by a piston, followed by transferring a predetermined amount of the extruded solution by a gear pump and subsequently filtering the extruded solution through a sintered filter of 10 μm in pore size. Further, the filtered extrudate was passed through a spinning nozzle having 300 pores each pore having a pore diameter of 0.30 mm and a pore length of 0.5 mm so as to discharge the filtered extrudate at a spinning rate of 5 m/min into a coagulating bath of 25° C. in temperature containing 20% by weight of sodium sulfate and having the pH value adjusted to 11 with boric acid and sodium hydroxide.

Then, the resultant regenerated collagen fiber was dipped in 16.5 kg of an aqueous solution containing 1.7% by weight of epichlorohydrin, 0.09% by weight of 2,4,6-tris (dimethylaminomethyl)phenol, 0.009% by weight of salicylic acid and 13% by weight of sodium sulfate at 25° C. for 24 hours.

After washing the resultant collagen fiber with a flowing water for one hour, it was dipped in 16.5 kg of an aqueous solution containing 6% by weight of basic aluminum chloride (made by Nihon Seika K. K.; Bercotan A C-P; hereinafter the same) and 5% by weight of sodium chloride at 30° C. for 12 hours, followed by washing the resultant fiber with a flowing water for 2 hours.

Subsequently, the fiber was dipped in a bath filled with an oily agent consisting of an emulsion of an amino-modified silicone and PLURONIC polyether antistatic agent so as to allow the oily agent to adhere to the fiber, then dried under tension in a hot air convection dryer (TABAI ESPEC CORP; PV-221; hereinafter the same) whose temperature was set to 60° C. with fixing one end of the fiber bunch and applying a load of 0.04 g per d (1.1 dtex). As a result of measuring iron heat resistance, the hair iron heat resistance temperature was measured to be 160° C.

EXAMPLE 2

The same procedures as in Example 1 were conducted except for changing the amount of latex to 90 g (resin: 18 g). As a result of measuring iron heat resistance, the hair iron heat resistance temperature was measured to be 170° C.

EXAMPLE 3

The same procedures as in Example 1 were conducted except for changing the amount of latex to 270 g (resin: 54 g). As a result of measuring iron heat resistance, the hair iron heat resistance temperature was measured to be 180° C.

EXAMPLE 4

Emulsion polymerization was conducted using 80 parts by weight of methyl methacrylate, 20 parts by weight of butyl acrylate, and 1 part by weight of a surfactant of sodium laurylsulfate to obtain a latex containing 20% by weight of a solid component comprising resin particles having a glass transition temperature of 73° C. and a particle size of 0.1 μm.

90 g of the latex (resin: 18 g) was mixed with 1200 g (collagen content: 180 g) of leather pieces obtained by solubilizing split leather of a cattle with an alkali. Subsequent procedures were conducted in the same manner as in Example 1 except for changing the temperature of the hot air convection drying machine to 85° C. As a result of measuring iron heat resistance, the hair iron heat resistance temperature was measured to be 160° C.

EXAMPLE 5

The same procedures as in Example 4 were conducted except for changing the amount of latex to 180 g (resin: 36 g). As a result of measuring iron heat resistance, the hair iron heat resistance temperature was measured to be 170° C.

EXAMPLE 6

The same procedures as in Example 5 were conducted except for changing the temperature of the hot air conviction drying machine to 60° C. As a result of measuring iron heat resistance, the hair iron heat resistance temperature was measured to be 160° C.

EXAMPLE 7

The same procedures as in Example 2 were conducted except for conducting the insolubilizing treatment by dipping the regenerated collagen fiber in a 25° C. aqueous solution containing 15% by weight of sodium sulfate and 0.5% by weight of formaldehyde (pH being adjusted to 9 with boric acid and sodium hydroxide) for 15 minutes in place of the treatment with epichlorohydrin. As a result of measuring iron heat resistance, the hair iron heat resistance temperature was measured to be 180° C.

COMPARATIVE EXAMPLE 1

The same procedures as in Example 1 were conducted except for not mixing the latex. As a result of measuring iron heat resistance, the hair iron heat resistance temperature was measured to be 140° C., which is lower than that obtained by adding the thermoplastic resin and subjecting to the same crosslinking method.

COMPARATIVE EXAMPLE 2

The same procedures as in Example 1 were conducted except for changing the amount of latex to 1350 g (resin: 270 g). The resultant regenerated collagen fiber was so fragile that it suffered fiber breakage upon drying and not being taken out as thread.

COMPARATIVE EXAMPLE 3

The same procedures as in Example 7 were conducted except for not mixing the latex. As a result of measuring iron heat resistance, the hair iron heat resistance temperature was measured to be 160° C., which is lower than that obtained by adding the thermoplastic resin and subjecting to the same crosslinking method.

Data obtained in Examples and Comparative Examples are shown in Table 1.

TABLE 1

| | Compounded Thermoplastic Resin | | | | Regenerated Collagen Fiber | | |
|---|---|---|---|---|---|---|---|
| | Formulation (parts by weight) | Glass Transition Temperature (° C.) | Particle Size (μm) | Amount Per 100 Parts of Collagen (parts by weight) | Crosslinking Method | Drying Temperature (° C.) | Hair Iron Heat Resistant Temperature (° C.) |
| Example | | | | | | | |
| 1 | ST 60<br>BA 40 | 41 | 0.1 | 5 | ECH/AL | 60 | 160 |
| 2 | ST 60<br>BA 40 | " | " | 10 | " | " | 170 |
| 3 | ST 60<br>BA 40 | " | " | 30 | " | " | 180 |
| 4 | MMA 80<br>BA 20 | 73 | " | 10 | " | 85 | 160 |
| 5 | MMA 80<br>BA 20 | " | " | 20 | " | " | 170 |
| 6 | MMA 80<br>BA 20 | " | " | 20 | " | 60 | 160 |
| 7 | ST 60<br>BA 40 | 41 | " | 10 | FA/AL | " | 180 |
| Comp. Ex. | | | | | | | |
| 1 | — | — | — | — | ECH/AL | " | 140 |
| 2 | ST 60<br>BA 40 | 41 | 0.1 | 150 | " | " | Measurement being impossible due to serious fiber breakage |
| 3 | — | — | — | — | FA/AL | " | 160 |

Formulation of added resin: ST: styrene; BA: butyl acrylate; MMA; Methyl methacrylate;
Method of crosslinking the regenerated collagen fiber: ECH: eipchlorohydrin; FA: formaldehyde AL: Basic aluminum chloride It is seen from the results that heat resistance of the regenerated collagen fiber can be improved by incorporating the thermoplastic resin.

INDUSTRIAL APPLICABILITY

The invention is embodied in a method for improving heat resistance of the regenerated collagen fiber, which makes the regenerated collagen fiber into an extremely excellent product to be used as a substitute of human hair, for example, wig or hair piece, or head-decorating products such as doll hair. It is also embodied in a heat resistant regenerated collagen fiber.

What is claimed is:

1. A regenerated collagen fiber, comprising:

100 parts by weight of a regenerated collagen; and 1 to 100 parts by weight of a thermoplastic resin compounded with said regenerated collagen, wherein the thermoplastic resin is one obtained by polymerizing at least one member selected from the group consisting of alkyl acrylate monomers, alkyl methacrylate monomers, acrylic acid, methacrylic acid, vinyl cyanide monomer, aromatic vinyl monomers and halogenated vinyl monomers.

2. The regenerated collagen fiber as descried in claim 1, wherein the thermoplastic resin has a glass transition temperature of 0° C. to 120° C.

3. The regenerated collagen fiber as described in claim 1, wherein the thermoplastic resin has a glass transition temperature of 30° C. to 100° C.

4. The regenerated collagen fiber as described in claim 1, wherein the compound contains 3 to 80 parts by weight of the thermoplastic resin.

5. The regenerated collagen fiber as described in claim 1, wherein the compound contains 5 to 50 parts by weight of the thermoplastic resin.

6. The regenerated collagen fiber, as described in claim 1, wherein the resin comprises resin particles each having a size of 5 μm or less.

7. The regenerated collagen fiber as described in claim 1, wherein the fiber is formed by spinning.

* * * * *